US005356274A

United States Patent [19]

Lee

[11] Patent Number: 5,356,274

[45] Date of Patent: Oct. 18, 1994

[54] SUPPLYING SELF-SUCTION UNIT

[76] Inventor: Mu-Chun Lee, No. 41, Cherz Road, Hsin Tien, Taipei, Taiwan

[21] Appl. No.: 80,810

[22] Filed: Jun. 24, 1993

[30] Foreign Application Priority Data

Jun. 25, 1992 [CN] China ..... 92226018.4

[51] Int. Cl.[5] ..... F04B 21/00

[52] U.S. Cl. ..... 417/435; 417/542

[58] Field of Search ..... 417/542, 434, 435

[56] References Cited

U.S. PATENT DOCUMENTS

| | | | |
|---|---|---|---|
| 57,412 | 8/1866 | Van der Weyde | 417/542 |
| 736,443 | 8/1903 | Printz | 417/542 |
| 883,887 | 12/1906 | Nagel et al. | 417/542 |
| 1,201,660 | 10/1916 | Weatherhead et al. | 417/542 X |
| 1,301,209 | 4/1919 | Worden | 417/434 X |
| 2,687,696 | 8/1954 | Theis | 417/435 |
| 3,011,553 | 12/1961 | Ortman | 417/434 X |

*Primary Examiner*—Richard E. Gluck

*Attorney, Agent, or Firm*—Beveridge, DeGrandi, Weilacher & Young

[57] ABSTRACT

The present invention relates to a supplying self-suction unit, and more particularly to a supplying self-suction unit which includes a self-suction barrel which has a suction pipe connected with a storage tank, a water pipe interlinked with an inlet of a pump and a non-return valve installed in the top. A supplying barrel is included which has a bottom inlet pipe interlinked with an outlet of the pump. An outlet pipe extends from the top of the supplying barrel, and a non-return valve is installed in the top of the supplying barrel.

2 Claims, 5 Drawing Sheets

SUPPLYING SELF-SUCTION UNIT

BACKGROUND OF THE INVENTION

The pump has been playing a very important role in modern industry. Whether for transporting water or chemicals, without the pump, much would be impossible.

Apart from breakdown, a common problem with the operating pump is that the valve in the bottom of an intake suction pipe loses its non-return function. When the motor is off, the liquid remaining in the pump system will back flow to the original storage tank and leave the suction pipe having air inside causing the pump to race and be damaged when the pump is operated again. Consequently, a so-called "self-suction pump" has been developed to eliminate the aforesaid drawbacks.

A conventional self-suction pump is comprised of a storage tank, a separating tank, and a pump wherein vanes are installed to draw the liquid inside the storage tank and recycle the liquid so as to draw out the air in the suction pipe. However, such a pump has following drawbacks:

1. It cannot be installed on existing non self-suction type pumps.
2. The vane requires high pressure operation and is inconvenient to be adopted.
3. The loss in efficiency ratio due to the back-flow cycle ranges from 2% to 12%.

Therefore, a supplying self-suction unit is needed.

DETAILED DESCRIPTION OF THE PREFERRED EMBODIMENT

Figure 6:
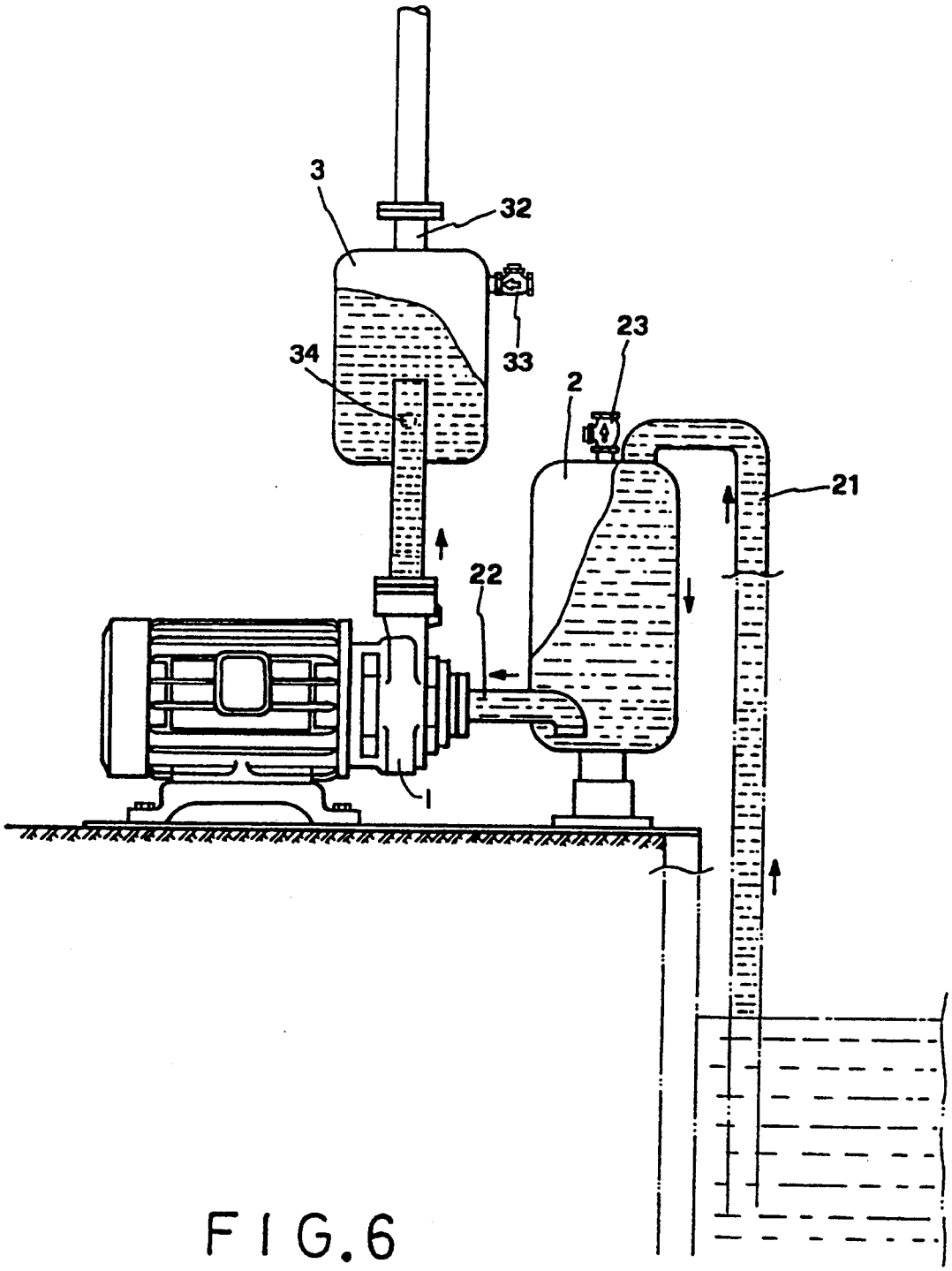
FIG. 6 is a sectional view of the self-suction barrel and the supplying barrel.

Referring to the Figures, the supplying self-suction unit of the present invention is comprised of a pump 1, a self-suction barrel 2 and a supplying barrel 3. The pump 1 is a prior art installation. Rotation of the pump is driven by a motor. The self-suction barrel 2 is a sealed container which has a suction pipe 21 connected with the liquid source tank, a liquid pipe 22 is interlinked with the inlet of the pump so as to draw the liquid through the liquid pipe 22. An upward non-return valve 23 is installed in the top of the self-suction barrel 2. The supplying barrel 3 is a sealed container having an inlet pipe 31 interlinked with the outlet of the pump 1, and a siphon-proof hole 34 is formed in inlet pipe 31 above the bottom of the supplying barrel 3 (as shown in FIG. 6). An outlet pipe 32 is installed at the top of the supplying barrel 3, and a non-return valve 33 is installed at the top of the supplying barrel 3.

Figure 1A:
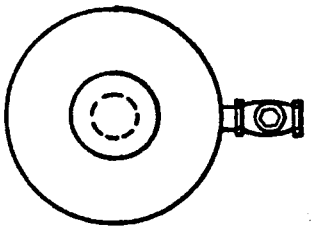
FIGS. 1A and 1B are a top and a front view, respectively, of the supplying barrel of the present invention.
Figure 1B:
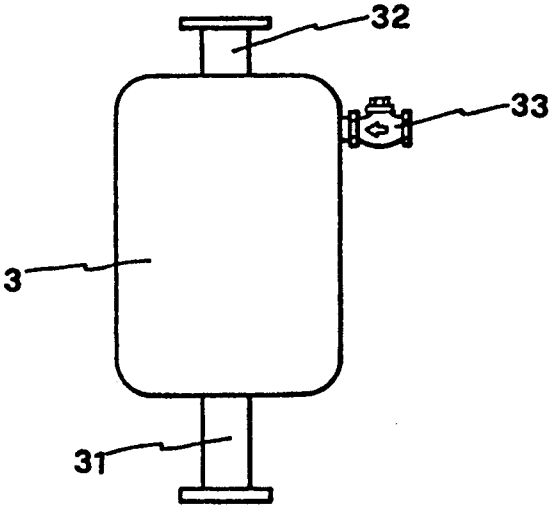
Figure 2A:
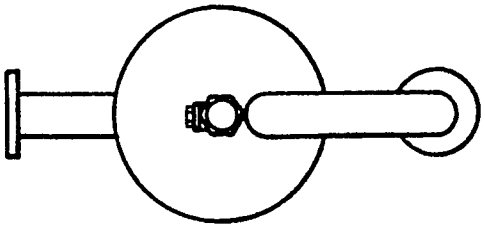
FIGS. 2A and 2B are a top and a front view, respectively, of the self-suction barrel of the present invention.
Figure 2B:
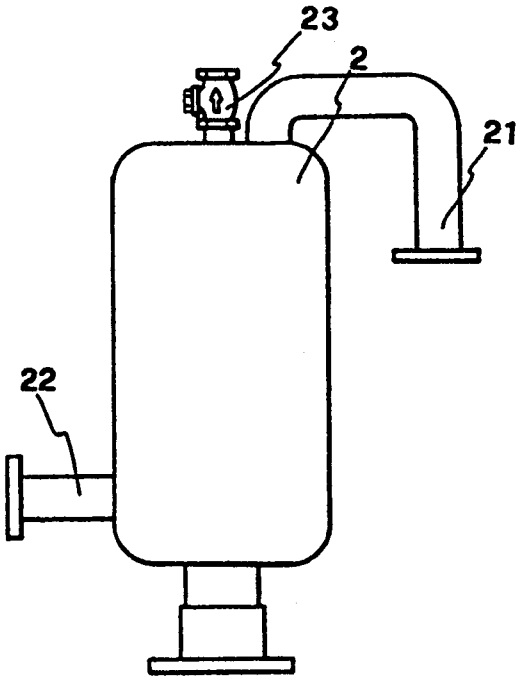
Figure 3:
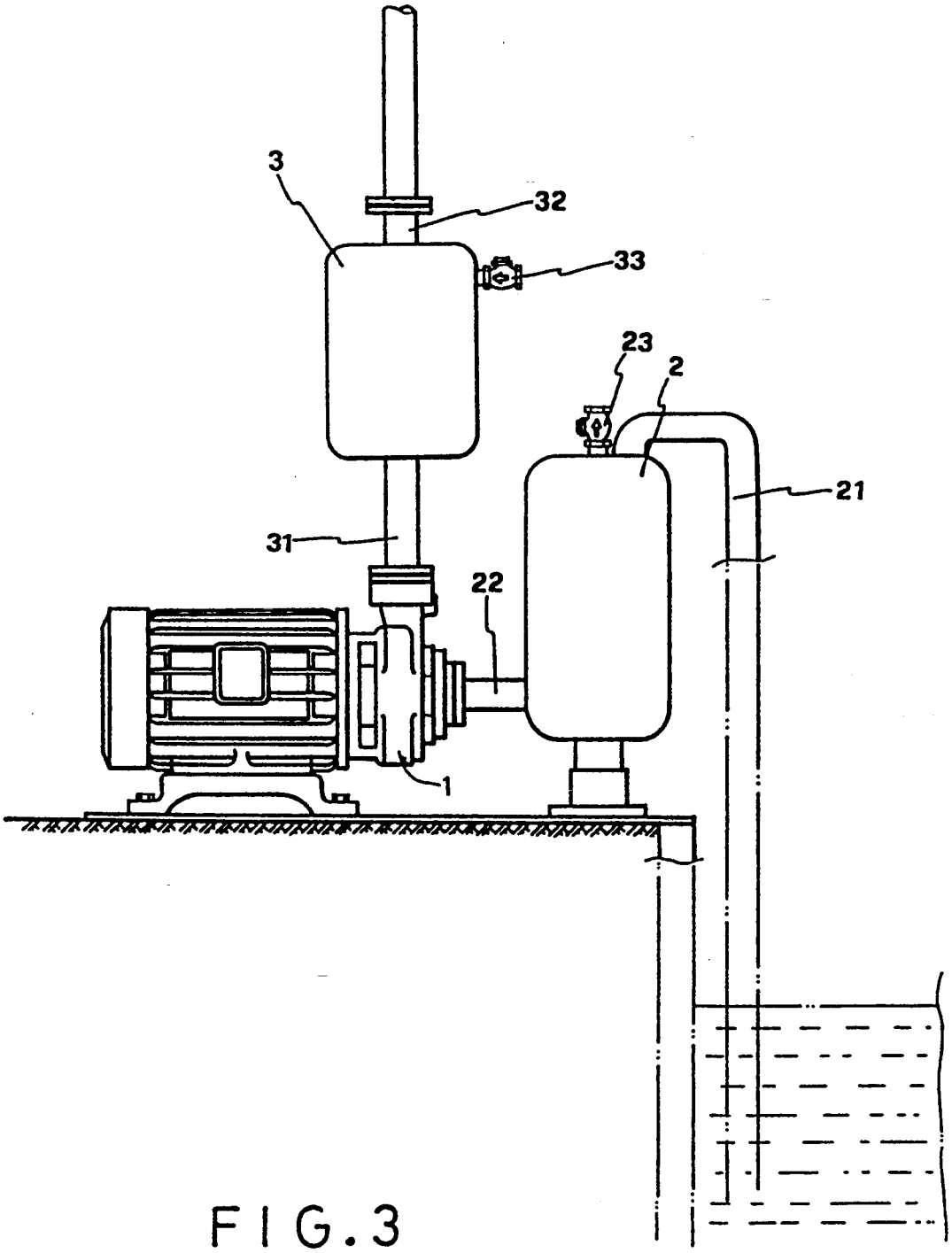
FIG. 3 depicts the supplying self-suction unit connected with the pump and the motor.

FIG. 3 illustrates a complete supplying self-suction unit.

Figure 4:
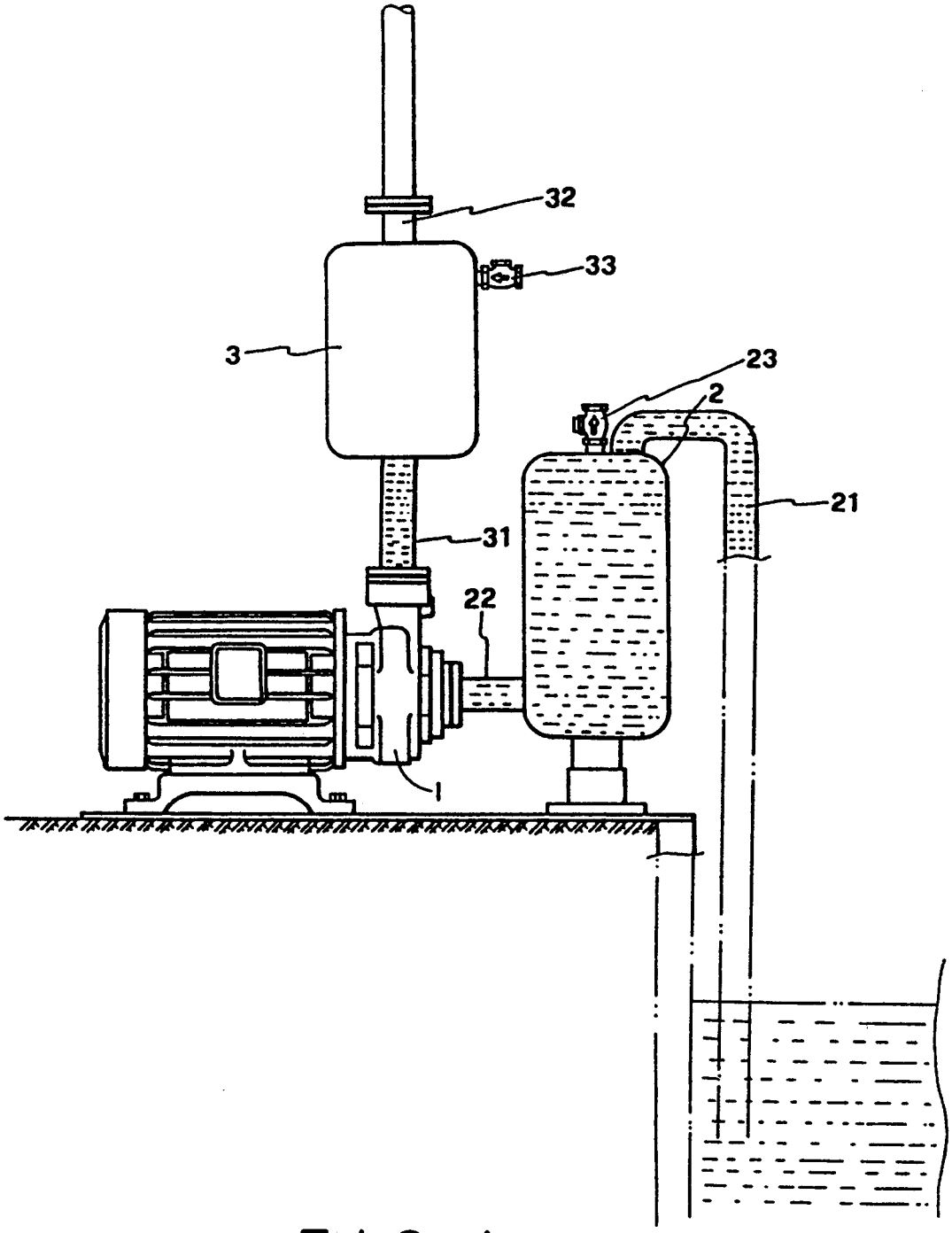
FIG. 4 is a schematic drawing of the liquid level of the self-suction unit filled with liquid.
Figure 5:
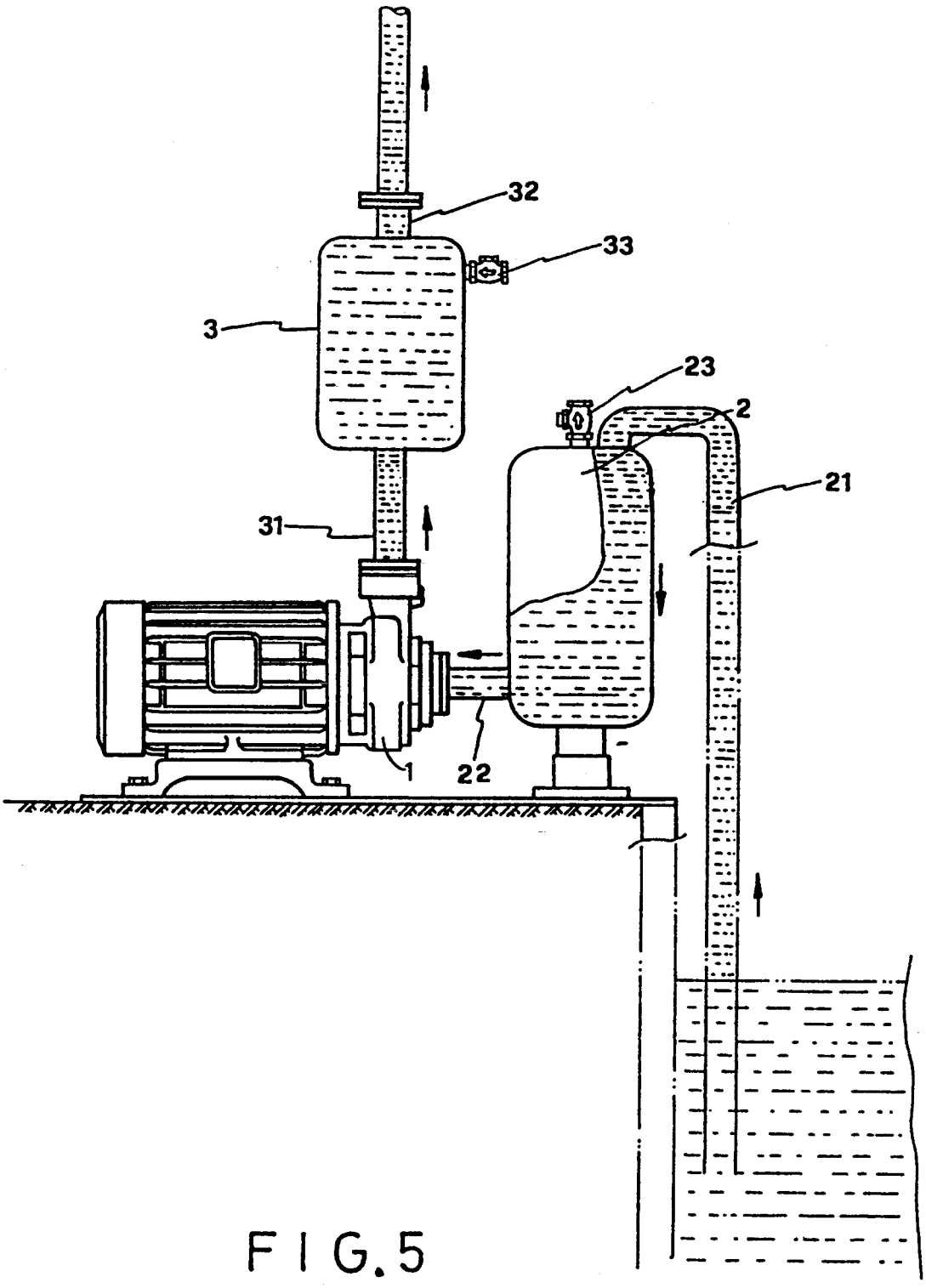
FIG. 5 is a schematic drawing of the flow direction of the liquid when the self-suction unit of the present invention is in operation.

Referring to FIG. 4, the operating process of the self-suction unit of the present invention is illustrated. First, the unit is filled with liquid through the mouth of the non-return valve 33 on supplying barrel 3 so as to fill the self-suction barrel 2 with liquid. The pump 1 can then be started. Initially, the liquid in the barrel will be drawn by the pump 1 in small quantities. However, the hydraulic seal of the liquid in the storage tank under the suction pipe 21 will cause the negative pressure to draw liquid from the storage tank to the self-suction barrel 2 through the suction pipe 21 so as to balance the pressure difference.

When the pump motor is off, the liquid in the supplying barrel 3 will back flow to the self-suction barrel 2 because of gravity and the opening of non-return valve 33. The non-return valve 23 in the top of self-suction barrel 2 is opened to exhaust air introduced into the self-suction barrel 2 when the supplying barrel 3 drains liquid so as to restore the liquid level for the next operation. As shown in FIG. 6, the hole 34 is at substantially the same height level as the non-return valve 23.

According to the above description, the supplying self-suction unit of the present invention has following advantages:

1. The function of self-suction can prevent the pump from racing during operation.
2. The supplying self-suction unit of the present invention can be installed in existing pump installations.
3. It is easy to install the supplying self-suction unit of the present invention, and the choice of supplying barrels and self-suction barrels is large.

What is claimed is:

1. A self-drawing pump apparatus comprising:

a pump having an intake and an outlet;

a self drawing tank having an upper portion and a lower portion, said tank lower portion being connected to the intake of said pump, said tank upper portion being connected to a pipe communicating with a liquid source, said tank further having an air outlet valve located at said tank upper portion; and a supplying barrel connected to said pump, said barrel having an upper portion and a lower portion, said barrel lower portion being connected to the outlet of said pump via an inlet pipe, said inlet pipe having an open distal end located within said supplying barrel, said inlet pipe further having a hole formed therein toward said barrel lower portion, said barrel further having an air inlet valve located at said barrel upper portion.

2. The self-drawing pump of claim 1, wherein said inlet pipe hole is located at a height level substantially equal to that of said air outlet valve.

* * * * *